US005607103A

United States Patent [19]

Boling, Jr.

[11] Patent Number: 5,607,103

[45] Date of Patent: Mar. 4, 1997

[54] MAILBOX WITH DUAL ACCESS MECHANISM

[76] Inventor: Wideman E. Boling, Jr., 12 Sylvatus Ct., Greenville, S.C. 29611

[21] Appl. No.: 526,870

[22] Filed: Sep. 12, 1995

[51] Int. Cl.[6] ..... B65D 91/00

[52] U.S. Cl. ..... 232/17; 232/43.4

[58] Field of Search ..... 232/17, 43.4

[56] References Cited

U.S. PATENT DOCUMENTS

| | | | |
|---|---|---|---|
| 3,106,335 | 10/1963 | Allan | 232/17 |
| 3,378,321 | 4/1968 | Frederick et al. . | |
| 3,891,139 | 6/1975 | Redling . | |
| 4,005,816 | 2/1977 | Malik . | |
| 4,205,778 | 6/1980 | File . | |
| 4,220,278 | 9/1980 | Hasselbring . | |
| 4,382,540 | 5/1983 | Kelly et al. | 232/17 |
| 4,447,005 | 5/1984 | Kelly et al. | 232/43.4 X |
| 4,757,927 | 7/1988 | Young | 232/17 |
| 5,449,111 | 9/1995 | Sauzedde et al. | 232/17 |

*Primary Examiner*—Kenneth J. Dorner
*Assistant Examiner*—Jerry Redman
*Attorney, Agent, or Firm*—Dority & Manning, P.A.

[57] ABSTRACT

A mailbox having a dual access mechanism is provided. The mailbox includes a housing having a pair of opposing doors pivotally mounted at each end. The opposing doors are interconnected by a flexible cable that extends along and adjacent to each side of the housing. At each door, the cable is received within a U-shaped tubular member pivotally mounted to each door. The mailbox can also include tubular elements mounted to the sides of the housing for further guiding the cable within the mailbox. The cable is provided with a predetermined length such that when one of the doors of the mailbox is opened, the cable causes the opposing door to close.

20 Claims, 4 Drawing Sheets

24
14
2
10
26
28
22
16
18
34
2
38
20
12
38
32
30

MAILBOX WITH DUAL ACCESS MECHANISM

BACKGROUND OF THE INVENTION

The present invention generally relates to mailboxes and more particularly to a mailbox having opposing doors that are interconnected.

The present invention is generally directed to mailboxes designed to be positioned at the side of a street or road. Such mailboxes are typically located remote from a residence for service by a postal worker who can deposit and remove mail from the mailbox without stepping out of his vehicle. Such mailboxes have traditionally presented various problems with their use.

For instance, because the mailboxes are positioned to be accessed by a vehicle, a person retrieving his mail typically has to step into the road or street in order to open the mailbox and remove its contents. When stepping into the street, a person has to be very cautious so as not to be struck by a car or otherwise interfere with traffic. Further, when approaching the street or road, a person must be wary of flying debris, water or slush which has deflected off a passing vehicle.

In the past, those skilled in the art have attempted to solve the above described problems by designing a mailbox with both a front door and a rear door. By providing two doors, mail can be inserted and removed from the rear of the mailbox without stepping into the street or road. However, if the front door were left open, or became open for any reason, one would still have to enter the street in order to return the door to its closed position. As such, a need exists for a dual access mailbox in which the front door can be closed without having to step in front of the mailbox.

In U.S. Pat. No. 4,220,278 to Hasselbring, a double door mailbox is disclosed having interconnected front and rear doors. Specifically, the doors are connected by a pair of link rods slideably connected to each other permitting either door to be opened or closed, but preventing the opening of both doors at the same time. The link rods are mounted and attached to the doors along a side of the mailbox in order to not interfere with the insertion or removal of mail. However, because the rods are only connected to each door along a side, problems can be encountered when trying to close a door by opening an opposing door. For instance, because the rods are only connected to one side of the door, the door may tend to not close evenly, especially if the door is made from a flexible material.

U.S. Pat. No. 4,005,816 to Malik also discloses a mailbox having doors at opposite ends. The doors are interconnected by a rod and a chain running along the outside of the mailbox. Where the chain and rod meet, a signal element is pivotally mounted. In this arrangement, when a door is opened, the signal element is automatically pivoted to a vertical or horizontal position for indicating when the mail has been delivered.

Other mailboxes with various signalling devices are also disclosed in U.S. Pat. No. 4,205,778 to File and in U.S. Pat. No. 3,891,139 to Redling. However, particular features and advantages of the present invention remain absent from the prior art as will be described in more detail hereinafter.

SUMMARY OF THE INVENTION

The present invention recognizes and addresses the foregoing disadvantages, and others of prior art construction and methods.

Accordingly, it is an object of the present invention to provide an improved mailbox.

It is another object of the present invention to provide a mailbox with a dual access mechanism.

It is still another object of the present invention to provide a mailbox having opposing doors that are interconnected such that when one door is opened, the opposing door is automatically closed.

These and other objects of the present invention are achieved by providing a mailbox including an elongated housing having a bottom and a top covering. The housing includes a first side and a second side and defines a first opening at a first end and a second opening at a second and opposite end. A first door is pivotally mounted to the housing at the first end. The door is moveable between an open position and a closed position. A second door is also provided similarly mounted to the housing at the second end. The second door is similarly moveable between an open position and a closed position.

The mailbox further includes an elongate member for interconnecting the first door to the second door. As used herein, an elongate member can refer to, for example, a flexible cable, a chain, a rope, metal bands, rods or cords. The elongate member includes a first segment extending along and adjacent to the first side of the housing and a second segment extending along an adjacent to the second side of the housing. The elongate member has a predetermined length such that, when one of the doors is opened, the elongate member causes the other of the doors to close.

Preferably, the elongate member extends between the doors of the mailbox within the interior of the housing but can also be positioned on the exterior of the housing if desired. The elongate member can be made from a flexible cable and can form a loop between the first door and the second door. The mailbox can also include tubular members pivotally connected to the doors for receiving the cable therein. The tubular members can have a U-shape and can have flared ends for facilitating movement of the cable therein.

The mailbox can also include guide means for guiding the cable along the sides of the housing. In one embodiment, the guide means can include tubular elements mounted to the housing for receiving and elevating the cable along the sides.

The mailbox can also include a coupling for fastening a pair of free ends of the cable together in order to form a loop. The coupling can be adjustable for varying the length of the loop formed by the cable. At least one spring can also be included and positioned within the loop of cable. The spring can be included for allowing either of the doors to be opened an extended amount beyond that normally permitted by the cable. The springs can be provided for opening the doors when it is necessary to place large packages and parcels within the mailbox.

These and other objects are also achieved by providing a mailbox having a dual access mechanism. The mailbox includes an elongated housing having a first open end and a second open end. A first door is pivotally mounted to the housing at the first open end and is movable towards and away from the opening. A second door is also similarly mounted to the housing at the second open end. A flexible cable extends adjacent to each side of the housing and interconnects the first door to the second door. The cable has a predetermined length such that only one of the doors maybe fully opened at any given time and such that, when one of the doors is opened, the opposing door is caused to close.

The mailbox further includes a first tubular member and a second tubular member mounted to each of the opposing doors respectively. Each of the tubular members has a U-shape and receives the flexible cable therein for interconnecting the opposing doors and for maintaining the cable adjacent to the sides of the housing. When one of the doors is opened, the tubular members pivot responsive to the tension applied to the cable.

The mailbox can further include guide means mounted to the sides of the housing. The guide means elevate and maintain the cable along and adjacent to the sides. In one embodiment, the guide means can include tubular elements for receiving the cable therein. The tubular elements and the tubular members mounted to the doors can have flared ends for facilitating the movement of the cable. Preferably, the cable forms a loop inside the housing and between the opposing doors. A coupling can be included for adjusting the length of the formed loop. The guide means and the tubular members can be used to maintain the loop at approximately the mid-height of the housing.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
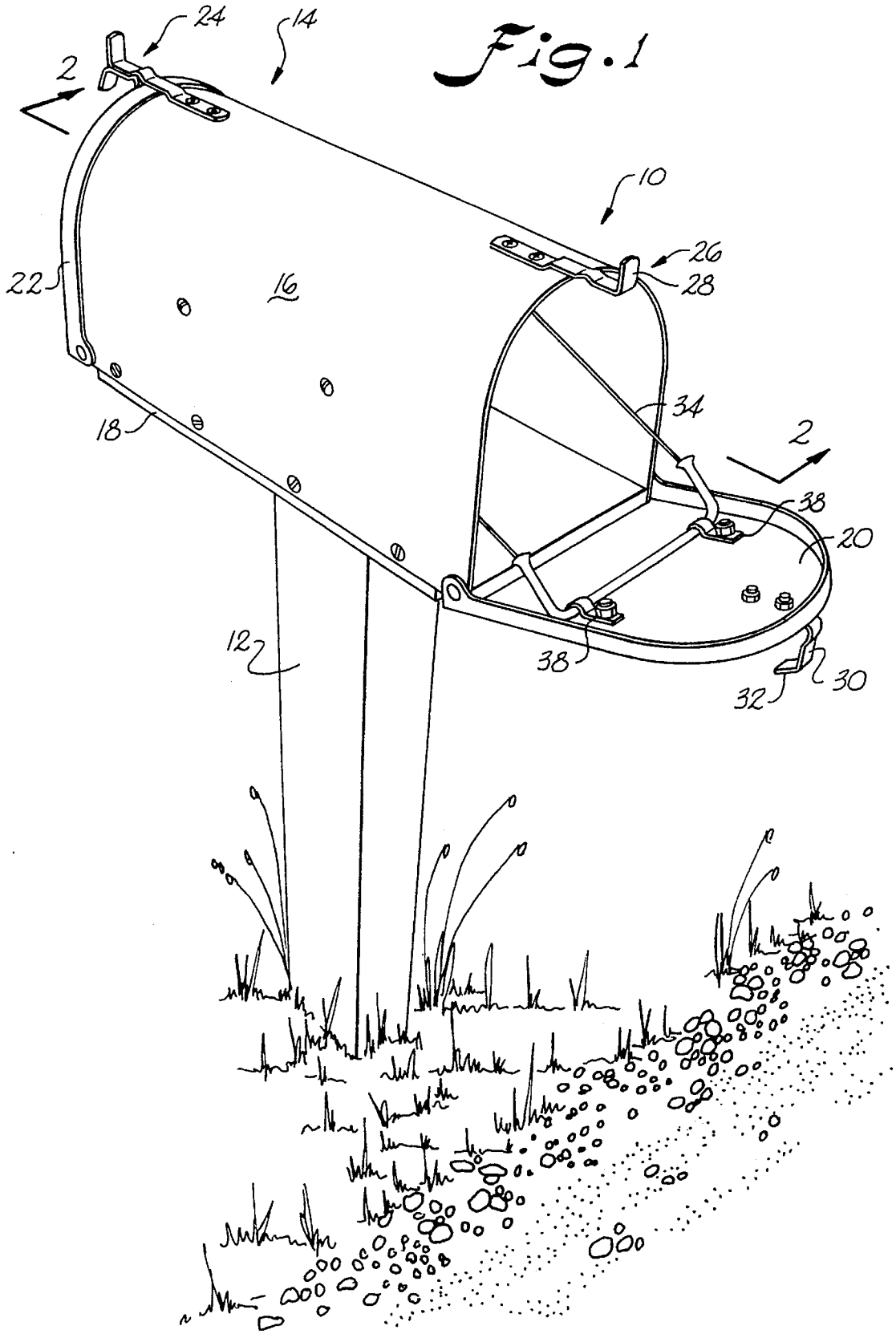
FIG. 1 is a perspective view of one embodiment of a mailbox made in accordance with the present invention.

Repeat use of reference characters in the present specification and drawings is intended to represent same or analogous features or elements of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a mailbox capable of being accessed from the front or the rear. As such, when the mailbox is placed near a street or a road, mail can be deposited or retrieved without having to step into the thoroughfare. According to the present invention, the mailbox also includes a mechanism by which when one door is opened the opposing door is automatically closed.

Referring to FIG. 1, one preferred embodiment of a mailbox generally 10 made in accordance with the present invention is illustrated. Mailbox 10, shown supported on a post 12, includes an elongated housing generally 14 defining a first open end and a second open end. In particular, housing 14 includes a top covering 16 secured to a bottom or base 18.

Pivotally connected to housing 14 at opposite ends are opposing doors 20 and 22. Doors 20 and 22 pivot between a closed position and an open position for providing access to the interior of the housing. When closed, doors 20 and 22 can be secured to housing 14 using conventional fasteners generally 24 and 26. As shown, fastener 26 includes a top clip 28 and a complimentary bottom clip 30. Bottom clip 30 further includes a tab 32 which can be used as a handle to open door 20.

In accordance with the present invention, mailbox 10 further includes a mechanism for interconnecting door 20 to door 22. For instance, preferably, a flexible cable 34 is provided that, in this embodiment, forms a loop between door 20 and door 22. As shown, cable 34 is secured to door 20 by a U-shaped tubular member 36. Tubular member 36 is, in turn, pivotally attached to door 20 by a pair of tube brackets 38. As illustrated, tubular member 36 is flared at its ends for facilitating movement of the cable.

Figure 2:
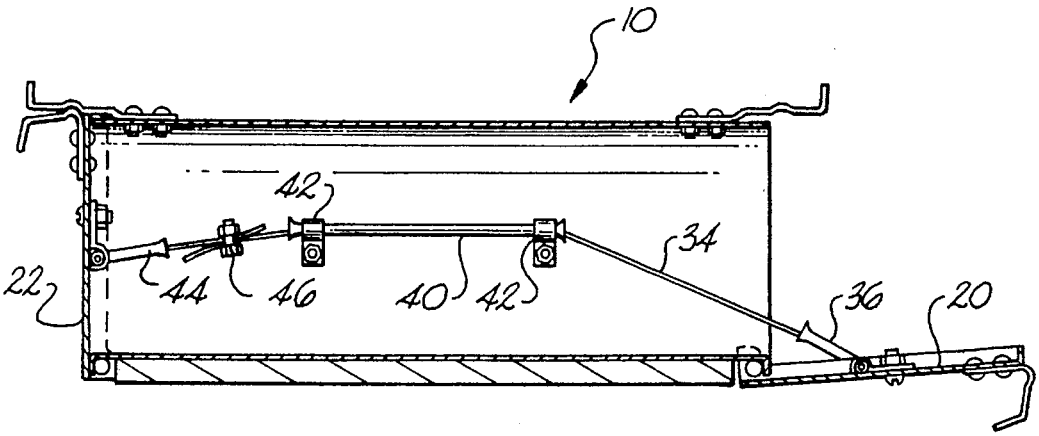
FIG. 2 is a cross-sectional view of the mailbox illustrated in FIG. 1 showing the right side door of the mailbox fully opened and the left side door fully closed.
Figure 3:
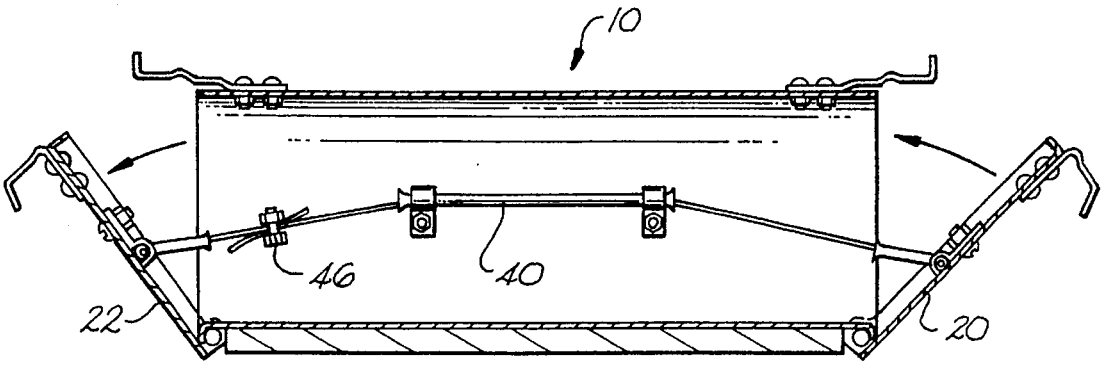
FIG. 3 is also a cross-sectional view of the mailbox illustrated in FIG. 1 showing both doors partially open.
Figure 4:
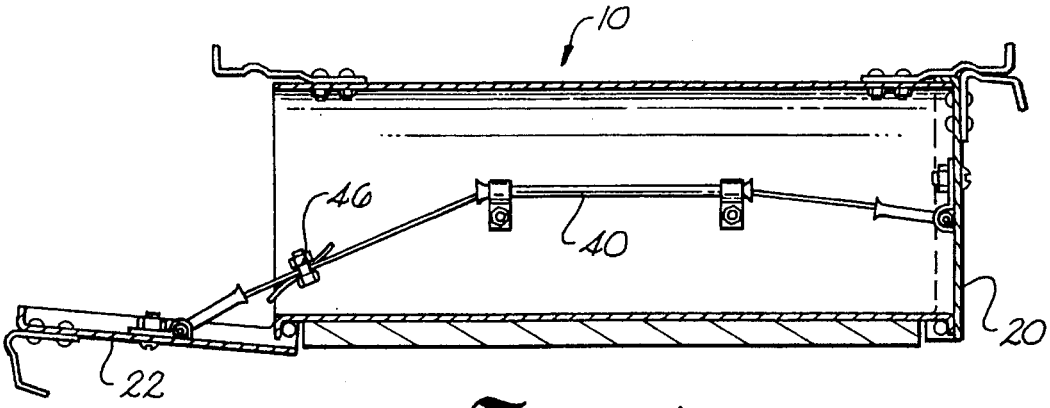
FIG. 4 is also a cross-sectional view of the mailbox illustrated in FIG. 1 showing the left side door fully opened and the right side door fully closed.

Referring to FIGS. 2, 3, and 4, the manner in which cable 34 interconnects door 20 to door 22 is more clearly shown. As illustrated, cable 34 is received within first tubular member 36 mounted to door 20. From tubular member 36, cable 34 extends into guide means 40 for elevating and maintaining cable 34 along the side of housing 14. In this embodiment, guide means 40 includes a tubular element within which the cable is received. Similar to tubular member 36, tubular element 40 is mounted to the side of housing 14 by a pair of tube brackets 42. Tubular element 40 also includes flared ends for facilitating the movement of the cable therethrough.

From guide means 40, cable 34 is then received within a second tubular member 44 mounted to door 22. Similar to tubular member 36, tubular member 44 is U-shaped, includes flared ends, and is pivotally connected to door 22.

Figure 5A:
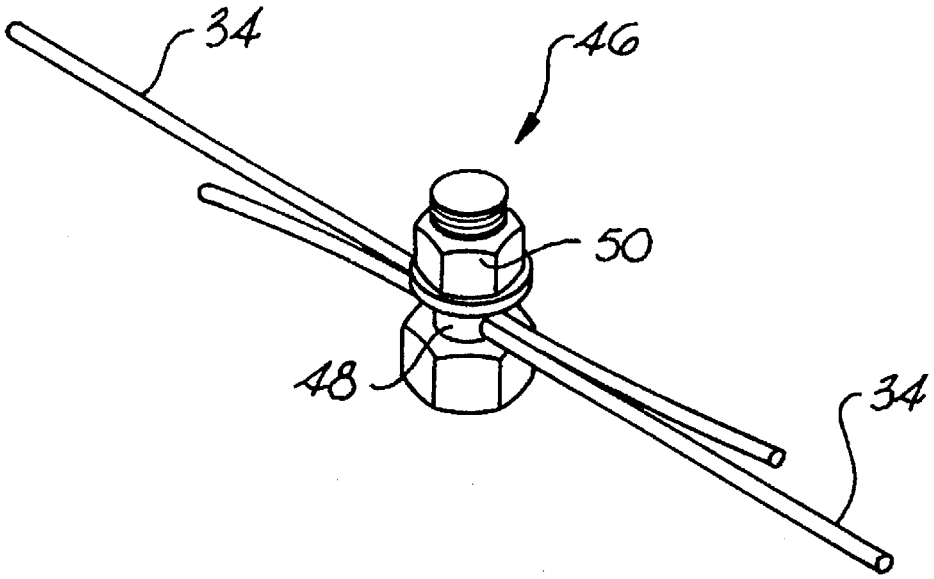
FIG. 5A is a perspective view of a coupling that may be used in the present invention to fasten the ends of a cable together.
Figure 5B:
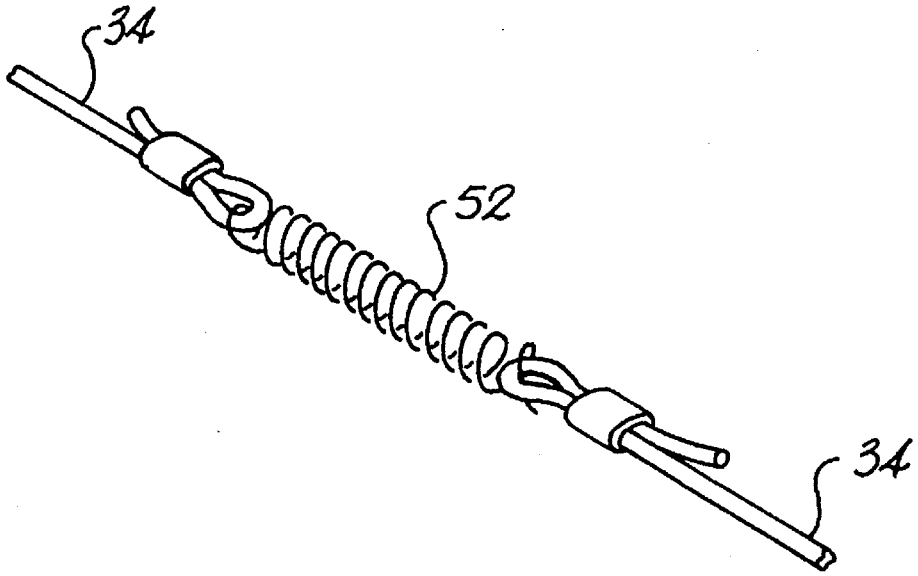
FIG. 5B is a perspective view of a spring that may be used in the present invention.
Figure 5C:
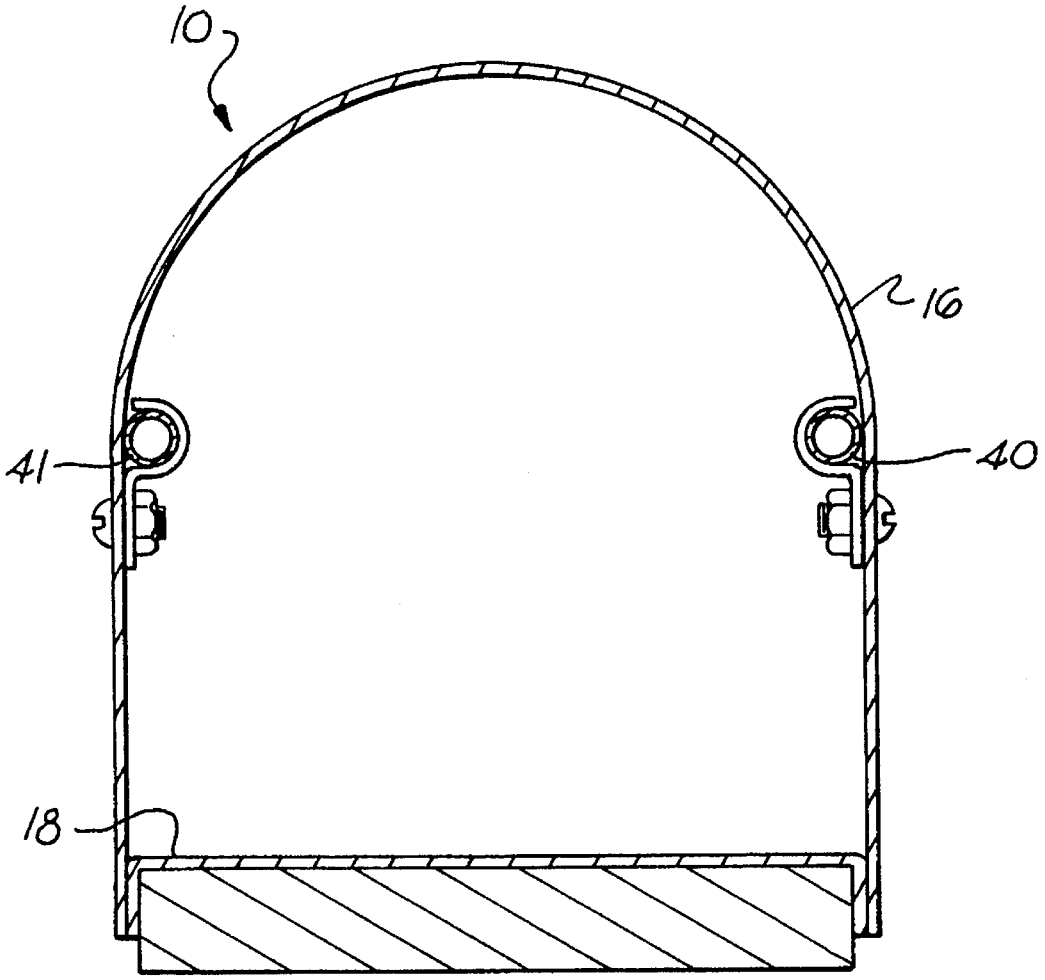
FIG. 5C is a cross sectional view midway along the length of the housing of the mailbox illustrated in FIG. 1.

As shown in FIG. 5C, after exiting tubular member 44, cable 34 is then received within a second guide means 41 identical to guide means 40 mounted to the opposite side of housing 14. From second guide means 41, cable 34 is again received within tubular member 36 as more clearly shown in FIG. 1. As such, cable 34 forms a loop or a circuit between doors 20 and 22. The tubular members and the guide means maintain the cable adjacent to the sides of the housing so that the cable will not interfere with the insertion or removal of mail. By extending along each side of the housing, the cable is capable of exerting a uniform force to each of the mailbox doors for closing same evenly as will be described in more detail below.

In order for cable 34 to form a loop within mailbox 10, a coupling 46 is included for fastening the ends of the cable together. Referring to FIG. 5A, one embodiment of coupling 46 is more clearly shown. Coupling 46 includes a shaft 48 defining a passage for receiving the ends of cable 34. A nut 50 is threaded onto shaft 48 for applying a clamping force to the ends of the cable. Coupling 46 allows the length of the loop formed by the cable to be adjusted. As shown in FIG. 2, preferably the cable length is adjusted so that only one door of the mailbox can be opened at any given time.

Viewing FIGS. 2, 3 and 4 in sequence, the dual access mechanism of mailbox 10 will now be described. Referring to FIG. 2, door 20 of mailbox 10 is shown in a fully opened position. When door 20 is fully opened, cable 34 becomes taught between door 20 and door 22.

Referring to FIG. 3, as indicated by the arrows, when door 22 is opened cable 34 causes opposing door 20 to close. During this process, the guide means maintain the cable adjacent to the sides of the housing. Also, since tubular members 36 and 44 are pivotally connected to doors 20 and 22 respectively, tubular members 36 and 44 rotate responsive to the direction of tension being applied to the cable. By being able to pivot, tubular members 36 and 44 facilitate the opening and closing of the doors and actually minimize the amount of pulling force that must be applied to a door in order to close an opposing door.

The tubular members and the guide means also work in conjunction to maintain the cable at a constant height within the housing. In particular, the height should be adjusted so that the cable can easily pivot the doors upward against the housing when used to close them. Preferably, the cable is maintained at approximately the mid-height of the doors.

As shown in FIG. 4, once door 22 is fully opened, cable 34 causes opposing door 20 to close. In this arrangement, a user can close an opposing door from the opposite side of the mailbox. During this process, as opposed to the prior art, the cable applies a uniform force to the door that is being closed. In particular, the cable extends along almost the entire width of the door. Consequently, instead of pulling the door from a single point on the side as taught in the prior art, the cable pulls the door along its width over a much larger area. As such, the door is brought into a closed position in an even fashion without allowing the door to twist or flex.

Although FIGS. 1 through 4 represent one preferred embodiment, the mailbox of the present invention can include other modifications and options. For instance, referring to FIG. 5B, a spring 52 is shown connected between two segments of cable 34. One or more of springs 52 can be placed within the loop formed by the cable. Preferably, a spring is placed at each end of the mailbox adjacent to each of the opposing doors. When included, spring 52 provides flexibility within the cable. In particular, the springs allow either of the doors to be opened an extended amount beyond that normally permitted by the cable. The springs are especially useful when it is necessary to open the doors beyond the fully opened position, such as when placing large packages or parcels within the mailbox.

Besides incorporating springs into the loop, cable 34 can also be modified in other ways. For instance, in an alternative embodiment, the cable can be placed on the outside of the mailbox housing. In this embodiment, the tubular members and the guide means would be mounted to the exterior sides of the doors and the walls.

Further, it is not necessary that cable 34 form a continuous loop between the opposing doors. For instance, instead of a loop, the cable may be divided into two segments extending along each side of the mailbox. Instead of being received within the tubular members, the ends of the segments can be welded or otherwise attached to the ends of the tubular members. In this embodiment, instead of a flexible cable, rods or metal bands that telescope may be used in interconnecting the doors. Of importance is that the elongate members, when used to close an opposing door, apply a uniform pulling force to a door for closing the door evenly.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

I claim:

1. A mailbox comprising:

an elongated housing having a bottom and a top covering and including a first side and a second side, said elongated housing defining a first opening at a first end and a second opening at a second and opposite end;

a first door pivotally mounted to said elongated housing at said first end, said first door being moveable between an open position and a closed position;

a second door pivotally mounted to said elongated housing at said second end, said second door being moveable between an open position and a closed position; and a flexible elongate member for interconnecting said first door to said second door, said elongate member forming a loop between said first door and said second door and including a first segment extending along and adjacent to said first side of said elongated housing and a second segment extending along and adjacent to said second side of said elongated housing, said elongate member having a length such that, when one of said first and second doors is opened, said elongate member causes the other of said first and second doors to close.

2. A mailbox as defined in claim 1, wherein said flexible elongate member comprises a cable.

3. A mailbox as defined in claim 2, further comprising tubular members pivotally connected to said first door and pivotally connected to said second door, said tubular members receiving said cable therein for interconnecting said opposing first and second doors.

4. A mailbox as defined in claim 3, wherein said tubular members are U-shaped and have flared ends, said tubular members being pivotally connected to each of said opposing first and second doors by at least one tube bracket.

5. A mailbox as defined in claim 2, further comprising a coupling for fastening a pair of free ends of said cable together.

6. A mailbox as defined in claim 2, further comprising at least one spring positioned within said loop formed by said cable.

7. A mailbox as defined in claim 1, wherein said flexible elongate member extends between said first door and said second door within said elongated housing.

8. A mailbox as defined in claim 1, further comprising guide means for guiding said flexible elongate member along the first and second sides of said elongated housing.

9. A mailbox as defined in claim 8, wherein said guide means comprises tubular elements mounted to said first and second sides of said elongated housing, said tubular elements receiving and elevating said flexible elongate member along said first and second sides.

10. A mailbox as defined in claim 1, wherein said flexible elongate member is connected to each of said opposing first and second doors at least at two attachment points.

11. A mailbox having a dual access mechanism, said mailbox comprising:

an elongated housing having a bottom and a top covering and including a first side and a second side, said elongated housing defining a first open end and a second open end;

a first door pivotally mounted to said elongated housing at said first open end, said first door being moveable towards and away from said first open end between an open position and a closed position;

a second door pivotally mounted to said elongated housing at said second open end, said second door being moveable towards and away from said second open end between an open position and a closed position;

a flexible cable extending adjacent to each of said first and second sides of said elongated housing and interconnecting said first door to said second door, said cable having a length such that only one of said first and second doors may be pivoted to said open position at any one time and such that, when one of said first and second doors is opened, said opposing first and second door is caused to close; and a first tubular member and a second tubular member pivotally mounted to each of said first and second doors respectively, each of said tubular members having a U-shape and receiving said flexible cable therein for interconnecting said first and second doors and for maintaining said cable adjacent to the first and second sides of said elongated housing.

12. A mailbox as defined in claim 11, wherein said tubular members have flared ends for facilitating movement of said cable therein.

13. A mailbox as defined in claim 11, further comprising guide means mounted to the first and second sides of said elongated housing, said guide means for elevating and maintaining said cable along the first and second sides of said elongated housing.

14. A mailbox as defined in claim 13, wherein said guide means comprises tubular elements for receiving said cable therein.

15. A mailbox as defined in claim 11, further comprising at least one spring in communication with said cable.

16. A mailbox as defined in claim 11, further comprising a coupling for fastening a pair of free ends of said cable together, said cable thereby forming a loop within said elongated housing between said first and second doors.

17. A mailbox comprising:

an elongated housing having a bottom and a top covering and including a first side and a second side, said elongated housing defining a first opening at a first end and a second opening at a second and opposite end;

a first door pivotally mounted to said elongated housing at said first end, said first door being moveable between an open position and a closed position adjacent to said first opening;

a second door pivotally mounted to said elongated housing at said second end, said second door being moveable between an open position and a closed position adjacent to said second opening;

guide means positioned along the first and second sides of said elongated housing;

a first tubular member and a second tubular member pivotally mounted to said first door and said second door respectively; and a loop of flexible cable interconnecting said first door to said second door, said cable being received within said first tubular member and said second tubular member and extending down the first and second sides of said elongated housing, said guide means elevating and maintaining said cable adjacent to each of said first and second sides, wherein said cable has a length such that when one of said first and second doors is open, the opposing first and second door, if left in an open position, is automatically closed.

18. A mailbox as defined in claim 17, wherein said guide means comprises tubular elements mounted to the first and second sides of said elongated housing for receiving said cable therein.

19. A mailbox as defined in claim 17, further comprising a coupling for fastening opposite ends of said cable together.

20. A mailbox as defined in claim 17, wherein each of said tubular members are mounted to said first and second doors by at least one bracket at approximately mid-height of said first and second doors.

* * * * *